US007201107B1

(12) United States Patent
Ruiter

(10) Patent No.: US 7,201,107 B1
(45) Date of Patent: Apr. 10, 2007

(54) ASSEMBLY WITH MOVABLE WORK SURFACE PORTION AND MATERIAL HOLDER

(75) Inventor: Joel Ruiter, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 337 days.

(21) Appl. No.: 10/785,270

(22) Filed: Feb. 24, 2004

(51) Int. Cl.
*A47B 37/00* (2006.01)

(52) U.S. Cl. ..... 108/50.01; 108/25

(58) Field of Classification Search ..... 108/50.01, 108/50.02, 25, 26, 137, 143, 42, 48, 47, 85, 108/87; 297/182
See application file for complete search history.

(56) References Cited

U.S. PATENT DOCUMENTS

| | | | | | |
|---|---|---|---|---|---|
| 486,602 | A * | 11/1892 | Morton | 108/25 |
| 1,353,866 | A * | 9/1920 | Vondree | 108/25 |
| 1,778,666 | A * | 10/1930 | Fox | 108/85 |
| 3,034,153 | A * | 5/1962 | Sargent | 108/25 |
| 3,386,444 | A * | 6/1968 | Brenner et al. | 108/25 |
| 3,586,409 | A | 6/1971 | Cisler | |
| 3,709,577 | A | 1/1973 | Rutherford et al. | |
| 3,729,244 | A | 4/1973 | Butler | |
| 3,736,884 | A * | 6/1973 | Kohner | 108/48 |
| 3,807,823 | A | 4/1974 | Rouse | |
| 3,871,726 | A | 3/1975 | Stenger | |
| 4,047,777 | A | 9/1977 | Pfeifer et al. | |
| 4,326,760 | A | 4/1982 | Ziegelheim et al. | |
| 4,536,044 | A | 8/1985 | Ziegelheim et al. | |
| 4,612,863 | A * | 9/1986 | Vonhausen et al. | 108/28 |
| 4,632,040 | A | 12/1986 | Sheffer | |
| 4,733,924 | A | 3/1988 | Lewis | |
| 4,750,794 | A | 6/1988 | Vegh | |
| 4,878,334 | A | 11/1989 | Quinn | |
| 4,886,326 | A | 12/1989 | Kuzyk | |
| 4,919,263 | A | 4/1990 | Baltzer et al. | |
| 5,518,309 | A * | 5/1996 | St-Pierre | 312/140.4 |
| 5,613,746 | A | 3/1997 | Green et al. | |
| 5,697,686 | A * | 12/1997 | Miller et al. | 312/194 |
| 5,769,514 | A | 6/1998 | Brown et al. | |
| 6,609,465 | B2 * | 8/2003 | Kolavo | 108/50.01 |

* cited by examiner

*Primary Examiner*—Jose V. Chen
(74) *Attorney, Agent, or Firm*—Rader, Fishman & Graue PLLC

(57) ABSTRACT

The present disclosure provides an assembly having a movable portion and a fixed portion. At least a portion of the movable portion comprises a work surface. The assembly further includes a storage device having a material holder that moves from a first position in a substantially covered configuration to a second position that uncovers or exposes at least a portion of the material holder so that a user can access the material holder and contents therein. A connection component connects the material holder to the movable portion and moves the material holder from the covered configuration to the uncovered, at least partially accessible, configuration by utilizing a translation of force from the movement of the movable portion.

31 Claims, 7 Drawing Sheets

ASSEMBLY WITH MOVABLE WORK SURFACE PORTION AND MATERIAL HOLDER

BACKGROUND

Office furniture has gained utility beyond mere decorative furnishing and now commonly provides an important and necessary means for an individual at home or at their place of work to perform their daily tasks, paperwork and job functions. A key piece of office furniture, the desk, is at the center point of office furniture and provides a place to store items such as papers and files, a work surface to allow an individual to work, and in some instances, provides access to components such as electrical outlets and network connections. Without the desk, one can readily imagine the difficulty that would ensue in conducting and performing routine office work.

While the desk is an integral part of performing office work, some drawbacks exist. With the extensive and ever increasing amount of papers and number of peripheral devices associated with a desk, the work surface of the desk oftentimes becomes cluttered to a point where use of the work surface of the desk is impeded. Increased clutter on the work surface of the desk results in reduced usable space. Reduced usable space impedes daily operations and work performance as the individual simply has no place to work.

In an attempt to address these drawbacks, some devices provide, for example, a pop-up keyboard tray that hides the keyboard when it is not in use. Although such devices do increase the amount of space on the work surface, the pop-up device is cumbersome as it utilizes a number of rigid components and a spring ejection mechanism, and typically must be located at a front portion of the desk in order to provide sufficient room for the pop-up mechanism to operate. Additionally, a cover must be removed in order to expose the keyboard tray such that it can be popped up. Even after removal, the cover commonly still impedes much of the workspace of the desk as the cover is simply moved from one place on the desk to another. The present invention was developed in light of these and other considerations.

SUMMARY

The present invention provides an assembly with a movable work surface portion and material holder having a movable portion and a fixed portion that includes a work surface of the assembly. The assembly further includes a material holder that moves from a first position to a second position that exposes at least a portion of the material holder to an external environment where the user of the assembly can access the material holder and contents therein. A movement component moves the material holder from a substantially covered position to an accessible position by utilizing a translation of force or resultant energy from the movement of the movable portion.

Other aspects of the invention will be apparent to those skilled in the art after reviewing the drawings and the detailed description below.

BRIEF DESCRIPTION OF THE DRAWINGS

The present invention will now be described, by way of example, with reference to the accompanying drawings, in which.

DETAILED DESCRIPTION OF AN EMBODIMENT

The present invention provides a device that can be used in conjunction with a desk top or other work surface to move a stored item from a first, closed or "stored" position inside an assembly with a movable work surface portion and a material holder to a second position that is at least partially accessible to a user. Movement of the stored item from a first position to a second, more accessible, position is done in connection with the movement of the movable portion of the work surface. In an embodiment of the invention, the assembly can be configured such that the stored item is raised within a space or opening formed between the movable portion and the remainder of the work surface, thereby conserving or better optimizing the amount of overall usable space on the work surface. As movement of the movable portion of the work surface causes the movement of the stored item, no extra or additional devices such as motors or springs are required to move the stored item from the first position to the second position. Consequently, work surface space on a work surface or desktop need not be unduly compromised. Moreover, the number of mechanical components of the device can commonly be reduced or minimized.

Figure 1:
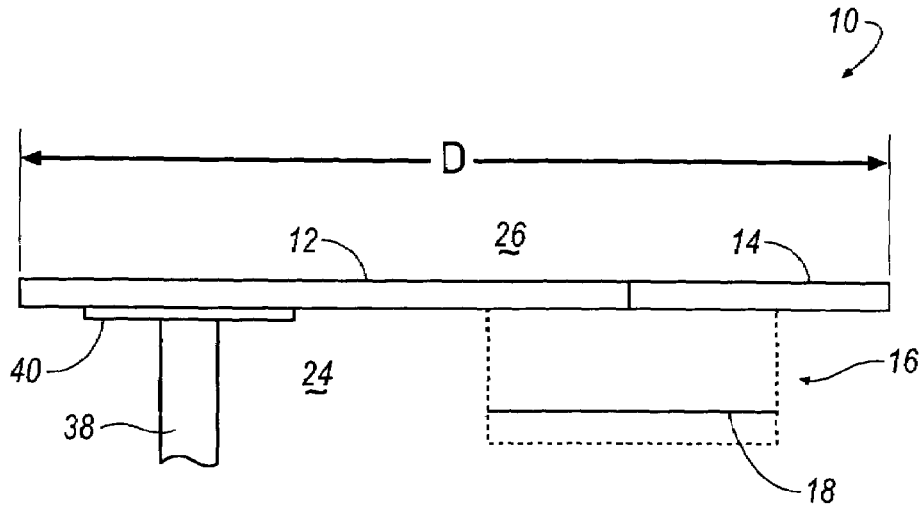
FIG. 1 is a schematic view of an assembly with a movable work surface portion and a material holder according to an embodiment of the present invention shown in a first configuration.

Referring now to FIG. 1, an assembly 10 is shown as including a movable portion 12 and fixed portion 14. Depending upon the desired configuration, the work surface of the assembly 10 may be comprised of all or portions of the movable portion 12, or all or portions of both the movable portion 12 and the fixed portion 14. The work surface generally divides a covered or internal environment 24 of the desk assembly 10 from an exposed or external environment 26. Although the terms internal environment and external environment are referred to, it will be understood that the term internal environment does not necessarily mean complete enclosure. Likewise, the term external environment does not necessarily require complete exposure. Instead, these are merely terms that refer to general ease of access by a user sitting at and using the work surface. By way of a non-limiting example, one using or sitting at the work surface would have easier access to an item located in the external environment than the internal environment.

The covered or internal environment 24 provides an area or space where various items such as pens, pencils, files and paper can be stored. The exposed or external environment 26 typically includes an area or space where the user of the assembly may work.

It should be noted that the assembly 10 shown in FIG. 1 is illustrative only, and that the invention may be comprised of a wide number of other configurations. For example, without limitation, the movable portion 12 may have a shorter or smaller external surface area than the fixed portion 14, or, the movable portion 12 may comprise all or substantially all of the visible work surface. In some embodiments, the fixed portion may be merely a back wall of the desk assembly 10 and may, in certain configurations, be completely covered (in top view) by the movable portion 12. Moreover, it should also be understood that, although not shown, the portions 12, 14 of the assembly 10 may include angled portions and the assembly 10 may optionally include additional features. For example, the assembly 10 may include items such as drawers, legs, holders, extensions, and other conventional components commonly included with work surfaces. For ease of illustration, however, the assembly 10 is a simple horizontal work surface and a general representation of a storage device 16, which will be subsequently described in further detail.

The work surface may be a substantially flat and level surface that provides a working surface for a user of the assembly 10 to write or to otherwise perform various tasks. In an embodiment of the invention, the work surface is comprised of the movable portion 12 and fixed portion 14 having an overall length of D as shown in side elevation such as depicted in FIG. 1. Preferably, the overall length D of the work surface during the operation of the invention, as will be described in greater detail hereinafter, remains substantially at or greater than D to maximize the available workspace for a user. However, the present invention is not limited to such an exemplary configuration.

Figure 2:
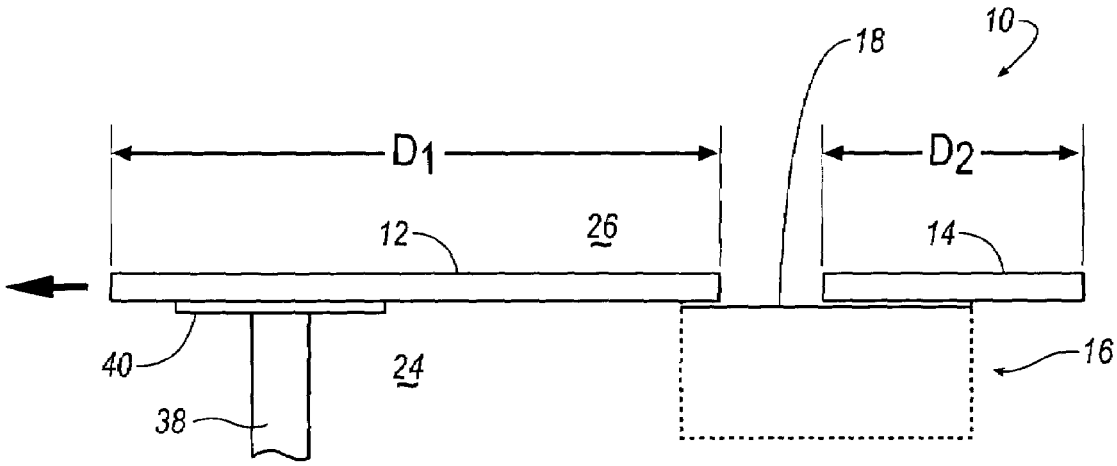
FIG. 2 is a schematic view of an assembly with a movable work surface portion and a material holder of the type illustrated in FIG. 1, shown in a second configuration.

The movable portion 12 is typically supported at a desired elevation by a support 38 and is in operative connection with a track 40 or other means for at least partially guiding the movement of the movable portion 12 through a range of motion. In an embodiment of the invention, such as generally illustrated in FIGS. 1 and 2, a track 40 may be configured to allow the movable portion 12 to move substantially horizontally with respect to both the support 38 and the fixed portion 14 while being supported by the support 38. The track 40 may be configured with nylon bars, channels, ball bearing supports or any other known means for supporting the movable portion 12 that allows the movable portion 12 to move in a sliding configuration. Additionally, one skilled in the art will readily recognize that the movable portion 12 does not necessarily need to move only in a sliding configuration but may move in alternate configurations understandable by one skilled and the art. In this way, the movable portion 12 is able to be moved toward and away from the fixed portion 14 for reasons that will be described in greater detail hereinafter. When the movable portion 12 is moved away from the fixed portion 14, a space or opening is created between the movable portion 12 and the fixed portion 14. The space or opening allows objects stored beneath the work surface of the assembly 10 to be raised and accessed through this space or opening.

In a first configuration, a storage device 16 is positioned or otherwise disposed in the covered or internal environment 24. The storage device generally includes a material holder 18, which may be integrally formed with the fixed portion 14 and the movable portion 12. The material holder 18 cooperates with the fixed portion 14 and the movable portion 12 to move the material holder 18 with respect to the space or opening formed between the movable portion 12 and fixed portion 14 to a position that is more readily accessible to a user. The material holder 18 can be comprised of a material holding device such as a file holder, tray, or any number of other suitable devices for holding items, as will be readily understood by one skilled in the art. The storage device 16 is preferably a device that utilizes the movement force or resultant energy from the movement of movable portion 12 relative to the fixed portion 14 to reposition material holder 18 for more convenient access by a user.

Figure 10:
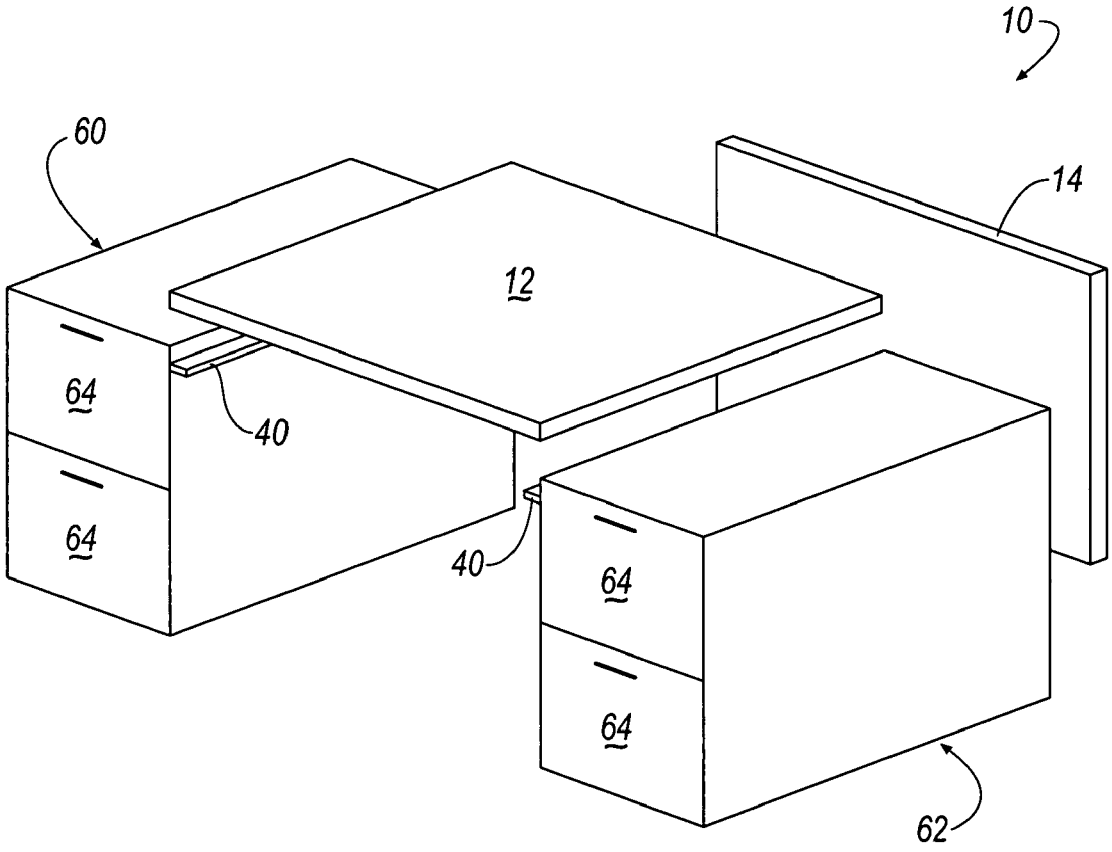
FIG. 10 is a perspective exploded view of a desk assembly kit according to an embodiment of the present invention.

Referring to FIG. 10, one example of the assembly 10 is shown including support members or pedestals, identified as 60 and 62, with a movable portion 12 disposed therebetween. A means for permitting the sliding of the movable portion 12 (including those previously discussed) such as tracks 40 cooperate with the movable portion 12 to allow the movable portion 12 to move back and forth with respect to the support members or pedestals 60 and 62. The support members or pedestals 60 and 62 can be any configuration and are shown in FIG. 10 to include a plurality of drawers 64. With the configuration shown in FIG. 10, both the tops of the support members or pedestals 60 and 62 as well as the top of movable portion 12 contribute to the overall work surface able to be utilized by an individual using the assembly 10.

Referring again to FIGS. 1 and 2, the operation of an embodiment of the present invention is further described. In operation, a user slides or moves movable portion 12 in a direction at least partially away from fixed portion 14, such as shown in FIG. 2. That action opens a space or opening between the movable portion 12 and the fixed portion 14. In response to this movement, the storage device 16 preferably moves the material holder 18 from a first, "covered" position (such as generally shown in FIG. 1) to a second, "uncovered" position (such as generally shown in FIG. 2). By moving the material holder 18 from the first position to the second position, the material holder 18 moves its contents from the covered internal environment 24 to at least a partially uncovered and accessible configuration via the space formed between the movable portion 12 and the fixed portion 14, thereby making its contents more accessible to a user. The storage device 16 accomplishes this movement through use of a device that translates the movement of the movable portion 12 into movement of the material holder 18. As such, the storage device 16 does not need to rely upon additional energy sources such as electric motors, springs or other means to move the material holder 18 to its uncovered position. As one skilled in the art will readily recognize, reverse movement of the movable portion 12 towards the fixed portion 14 retracts the material holder 18 from the external uncovered environment 26 to the covered internal environment 24 and substantially closes the space between movable portion 12 and fixed portion 14.

As can be seen, the length of overall available work surface before movement of movable portion 12 is approximately D. The available work surface after movement of movable portion 12 is D1+D2, which equals D. As can be seen, the overall available work surface does not materially change in the covered or uncovered configurations.

Figure 3:
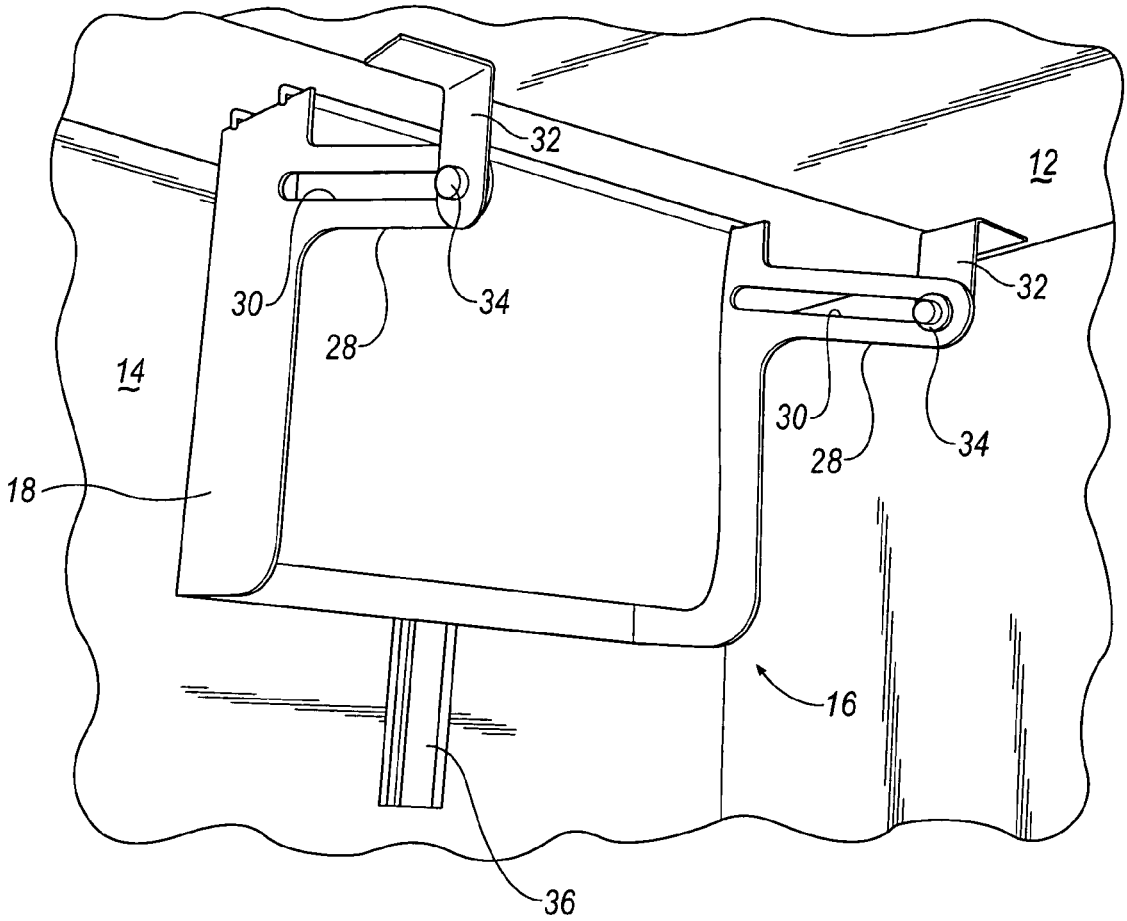
FIG. 3 is a perspective view of a storage device according to an embodiment of the present invention.

Referring now to FIG. 3, another embodiment of the present invention is shown and described. FIG. 3 illustrates an embodiment of a storage device 16 as seen from the covered or internal environment 24 of the assembly 10. In FIG. 3, the material holder 18 is shown in the form of a file holder. Of course, the material holder 18 may be any other suitable means for holding material. The storage device 16 may include one or more tracks 28, brackets 32, and/or guides 34 that may be disposed on opposite sides of the material holder 18. For instance, brackets 32 can be connected or secured to a portion of an underside of the movable portion 12. The brackets 32 may further be attached to guides 34 that, in turn, may engage slots 30 of tracks 28. In an embodiment, tracks 28 may be angled with respect to a horizontal plane parallel with the movable portion 12. For reasons which will be discussed, this angled configuration allows the material holder 18 to at least partially move vertically in response to movements (which may include horizontal movement) of the movable portion 12. It will also be understood that by changing the degree of the angle, one can change the speed and distance that the material holder 18 travels in a substantially vertical direction. In embodiments of the invention, tracks 28 may, for instance, be angled 30°, 45° or 60° with respect to a horizontal plane. However, one skilled in the art will readily recognize modifications and variations to these angles.

A vertical track 36 may also be included and may cooperate with the material holder 18 to allow the material holder 18 to move only or substantially in a vertical direction with respect to the movable portion 12. The vertical track 36 can guide the material holder 18 so as to generally prohibit movement of the material holder 18 in other directions when the movable portion 12 is moved. By this way, force or resultant energy from moving the movable portion 12 is used only to move the material holder 18 in the desired (e.g., vertical) direction. Of course, one skilled in the art will readily recognize that alternate directions may be used and that the material holder 18 does not need to be limited to traveling in only one direction.

Figure 4:
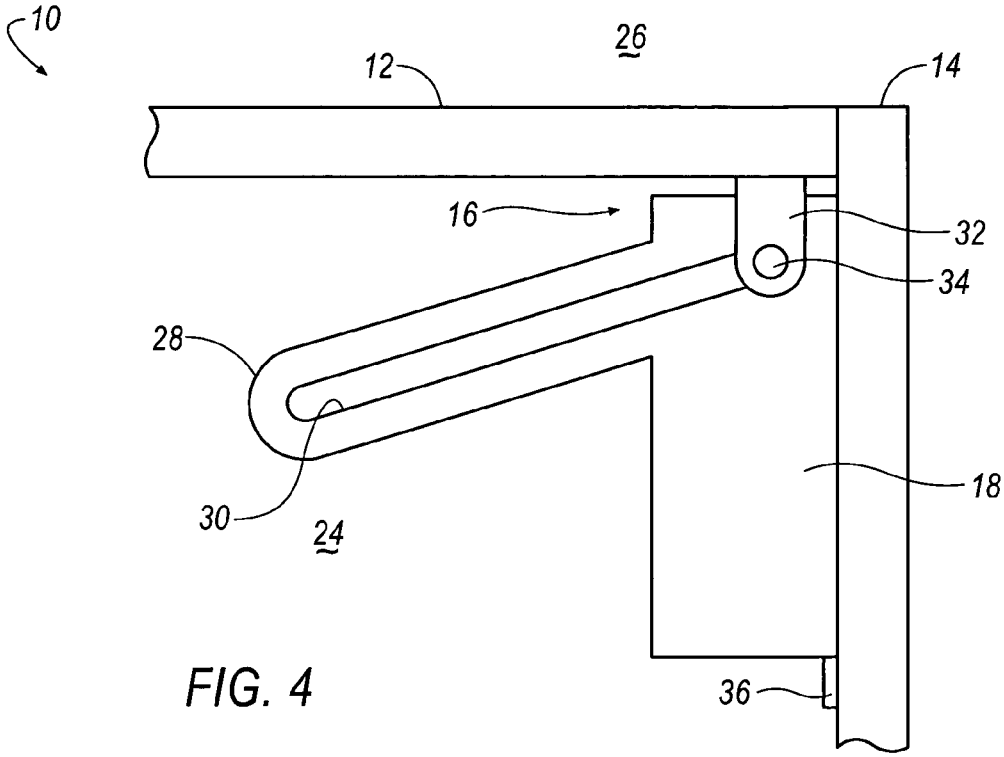
FIG. 4 is a schematic view of an assembly with a movable work surface portion and a material holder according to an embodiment of the present invention shown in a first configuration.
Figure 5:
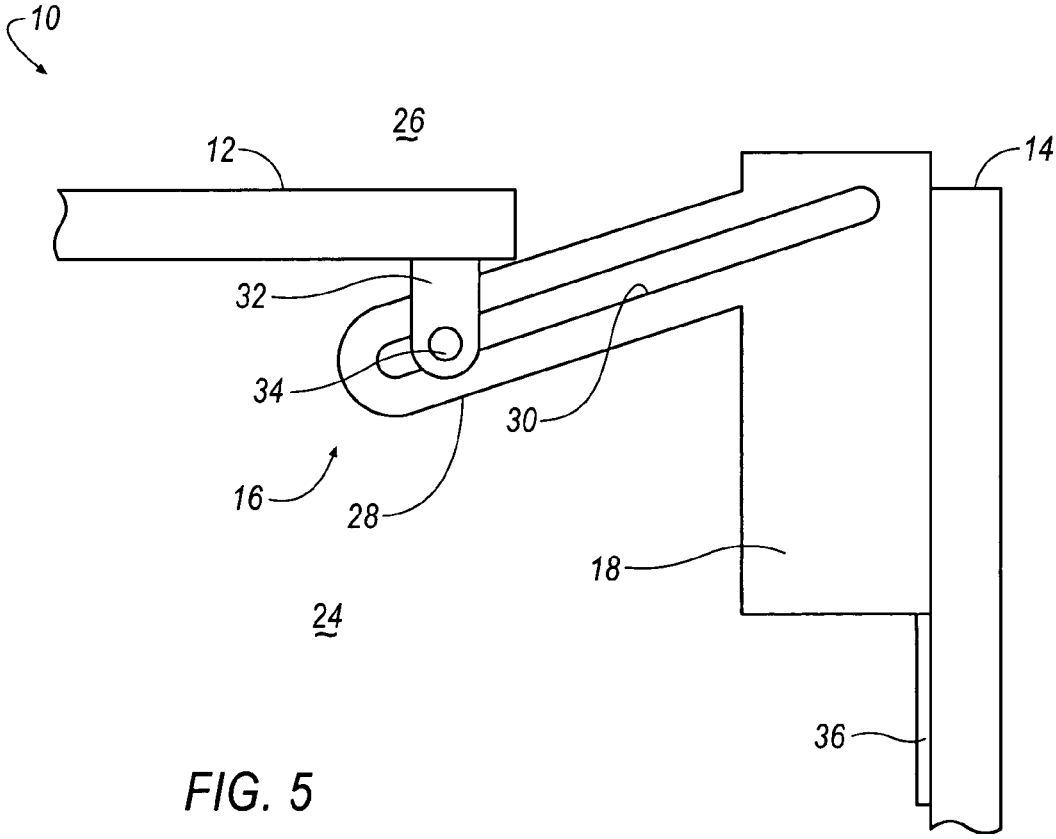
FIG. 5 is a schematic view of an assembly with a movable work surface portion and a material holder of the type illustrated in FIG. 4, shown in a second configuration.

Referring to FIGS. 4 and 5, the operation of the embodiment shown in FIG. 3 is further illustrated and described. In FIG. 4, the material holder 18 is shown in the first position as residing within the covered internal environment 24. Here, guide 34 is positioned at an upper rightmost position along the associated slot 30. The movable portion 12 is then moved in a direction away from the fixed portion 14 to a position such as generally shown in FIG. 5. During this movement, the guide 34 presses against an upper surface of the slot 30 and pushes or force the material holder 18 in an upward direction along the vertical track 36. This moves the material holder 18 from the covered internal environment 24 as shown in FIG. 4 to the uncovered external environment 26 as shown in FIG. 5. As can be seen, the force or energy used to move the movable portion 12 at least partially forces or raises the material holder 18 in the upward direction. By this way, a user of the desk assembly 10 can access files within the material holder 18.

Figure 6:
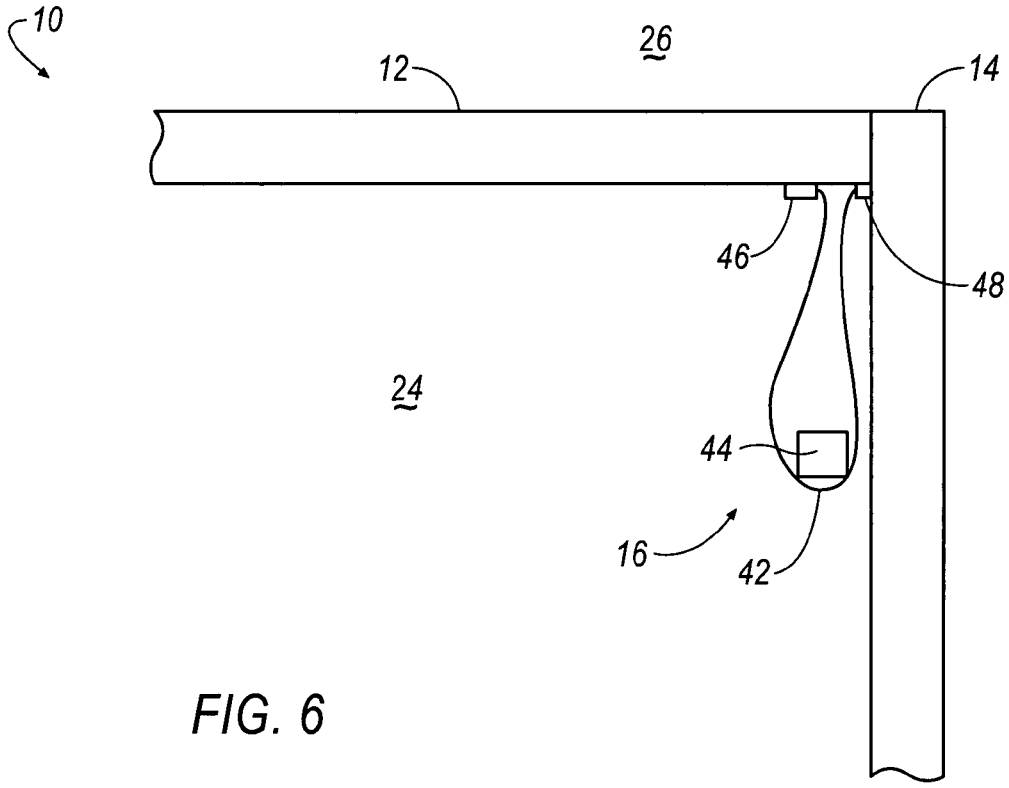
FIG. 6 is a schematic view of an assembly with a movable work surface portion and a material holder according to an embodiment of the present invention shown in a first configuration.
Figure 7:
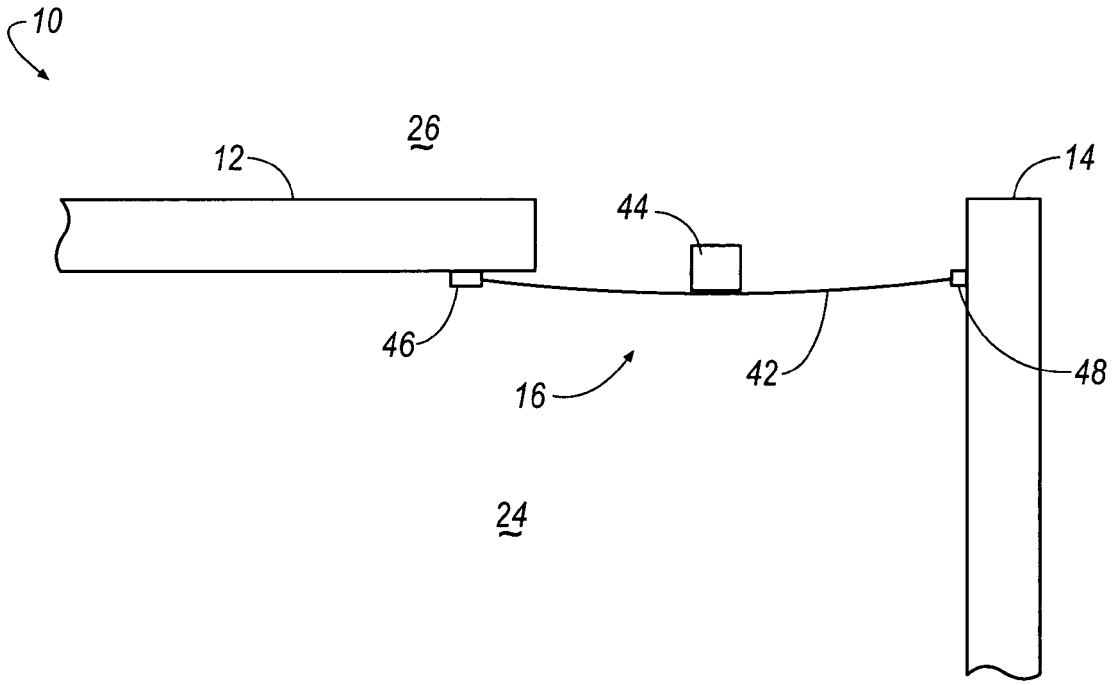
FIG. 7 is a schematic view of an assembly with a movable work surface portion and a material holder of the type illustrated in FIG. 6, shown in a second configuration.
Figure 8:
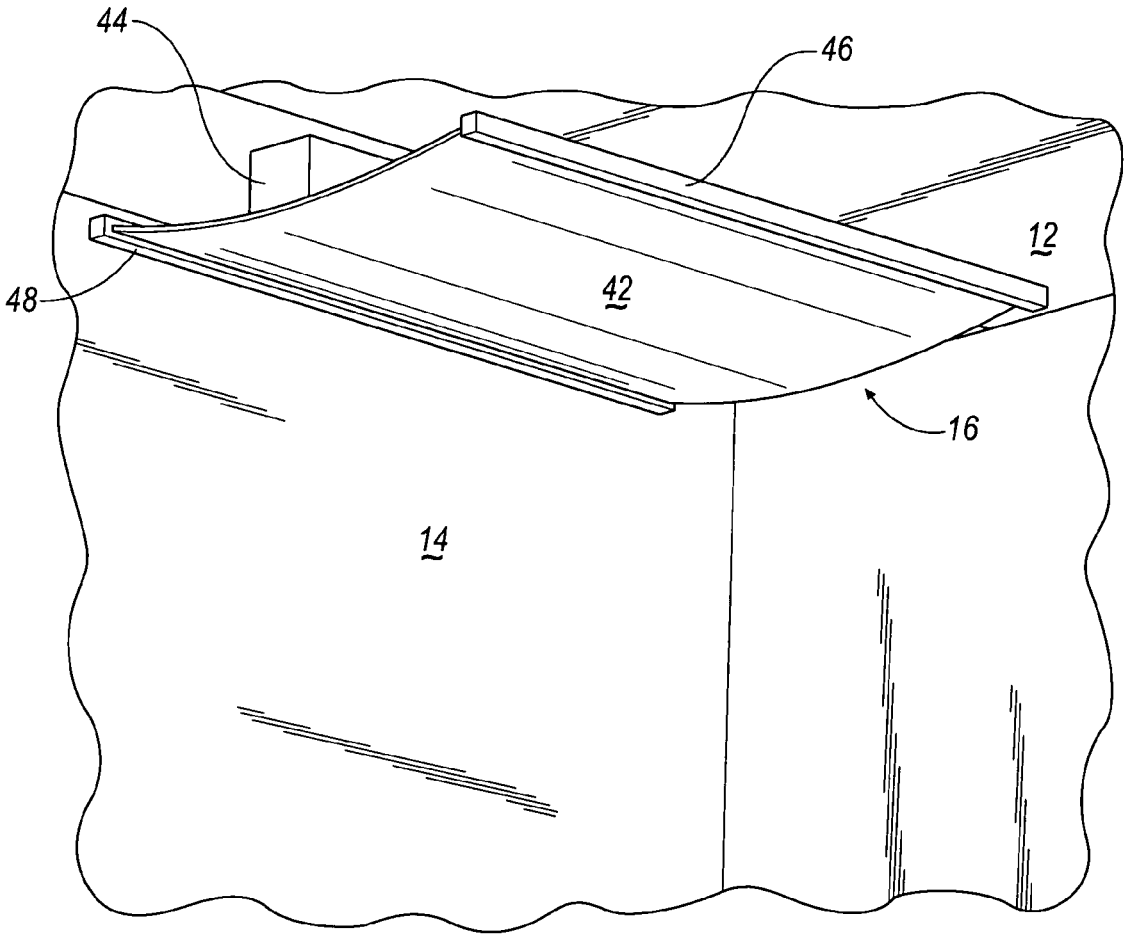
FIG. 8 is a perspective view of an assembly with a movable work surface portion and a material holder of the type illustrated in FIG. 6.

Referring now to FIGS. 6, 7 and 8, another embodiment of the present invention is shown and described. As shown in FIGS. 6 and 8, the storage device 16 includes a flexible member 42 having an end attached to the movable portion 12 by connector 46 and having another end attached to the fixed portion 14 by connector 48. The connectors 46 and 48 can be any suitable connection means such as a nail, screw, thumb tack, glue, other adhesive, any other suitable means of connection or fastener, or integral formation such as by being integrally formed with the movable portion 12 and the fixed portion 14. One skilled in the art will readily recognize alternate and other means of connection between the movable portion 12, fixed portion 14 and flexible member 42. The flexible member 42 can be comprised of any number of materials that provide sufficient support for the intended contents and permit the desired function. Some examples of materials that may comprise the flexible member 42 include without limitation, cloth, plastic, rubber, or various combinations of the foregoing.

A component 44, for example an electrical outlet bus, may be positioned within the cavity or pouch formed by the flexible member 42 in a folded or relaxed state. In operation, the movable portion 12 is moved away from the fixed portion 14. This movement causes the flexible member 42, shown in a substantially relaxed position in FIG. 6, to stretch to a substantially taut or un-relaxed position as shown in FIG. 7. This un-relaxed position moves a component 44 from a first position within covered internal environment 24 to a second position that exposes the component 44 for potential access. In this manner, a component 44 can be moved from a position not as readily accessible to a user to a position that is more accessible.

Figure 9:
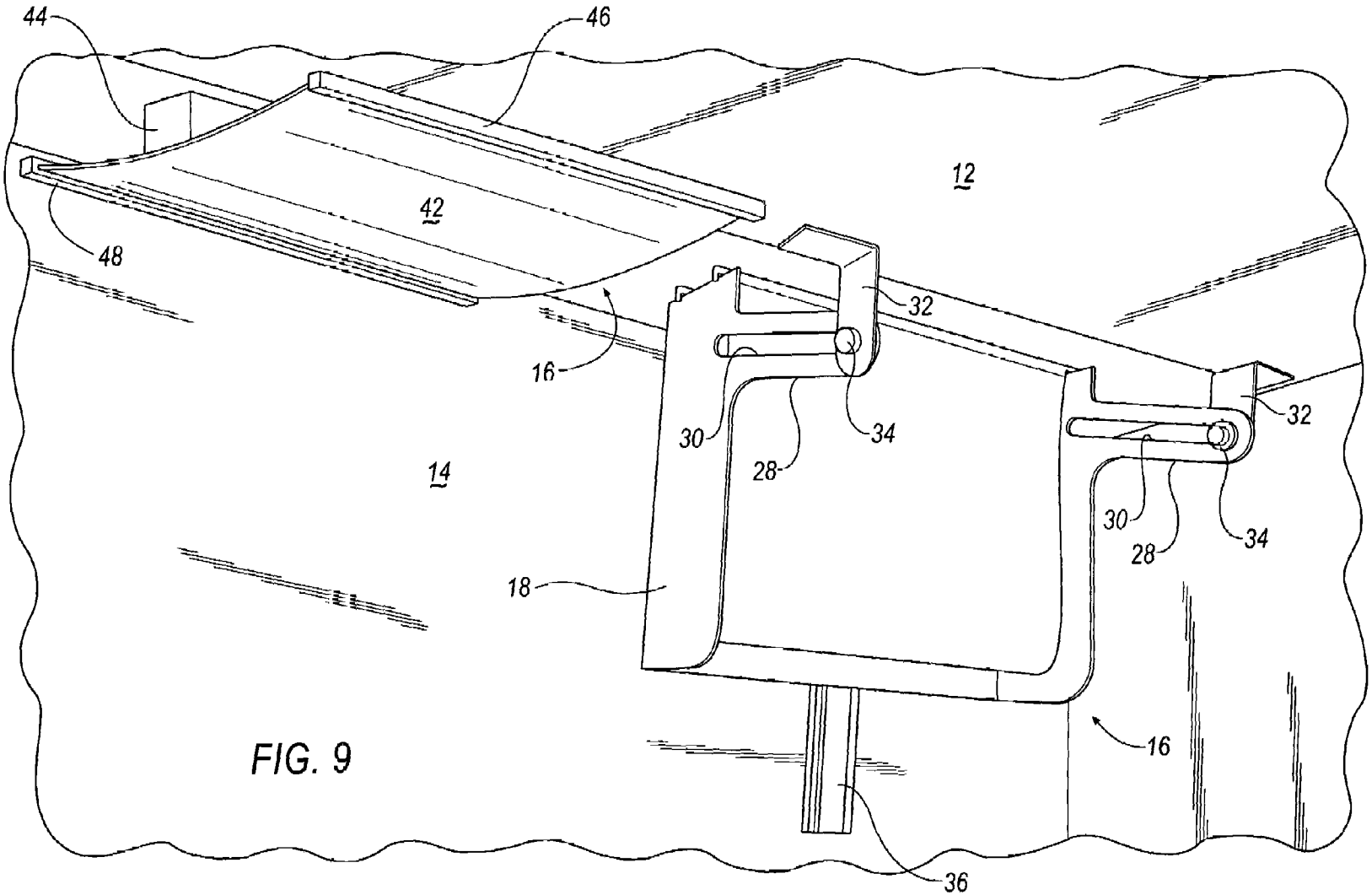
FIG. 9 is a perspective view of another embodiment of an assembly combining the movable work surface portions and material holders of the type illustrated in FIG. 6 and FIG. 4.

FIG. 9 illustrates another embodiment of the present invention. In FIG. 9, both of the embodiments shown in FIGS. 3 and 8 are shown with their respective storage devices 16 positioned generally adjacent or next to each other and attached to the assembly 10. The attachment and operation of the storage devices 16 in FIG. 9 are the same as illustrated and described with respect to the previous embodiments. However, by combining the embodiments of the types shown in FIGS. 3 and 8 into one assembly 10, both files and electrical devices can be stored in the assembly 10.

While the present invention has been particularly shown and described with reference to the foregoing preferred and alternative embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A work surface assembly comprising:

a fixed portion;

a movable portion adapted to move with respect to the fixed portion; and a storage device including a material holder in connection with the movable portion and the fixed portion and a track, wherein the track is connected to the material holder and extends in a direction of movement of the moveable portion; wherein the track is adapted to receive a guide connected to the movable portion;

wherein the material holder moves from a first position to a second position in conjunction with movement of the movable portion; and wherein in the first position the material holder is located in a substantially covered configuration and in the second position at least a portion of the material holder is in an uncovered configuration.

2. The work surface assembly according to claim 1, wherein an external surface of the fixed portion and an external surface of the movable portion comprise a work surface and a size of the work surface in the first position is substantially equal to a size of the work surface in the second position.

3. The work surface assembly according to claim 1, wherein the material holder is comprised of a file holder, a tray, a pouch, or a pocket.

4. The work surface assembly according to claim 1, wherein the material holder is comprised of a flexible member.

5. The work surface assembly according to claim 4, wherein the flexible member has a first end connected to the movable portion and a second end connected to the fixed portion.

6. The work surface assembly according to claim 4, wherein the movement of the movable portion reconfigures the flexible member from a substantially un-flexed configuration in the first position to a substantially flexed configuration in the second position.

7. The work surface assembly according to claim 4, further comprising a component positioned in the flexible member.

8. The work surface assembly according to claim 1, wherein:

the track includes a slot;

at least a portion of the guide rests within the slot; and movement of the movable portion moves the guide along the slot to move the material holder from the first position to the second position.

9. The work surface assembly according to claim 8, wherein a bracket connects the guide and the movable portion.

10. The work surface assembly according to claim 1, further comprising a vertical track cooperating with the fixed portion and the material holder to substantially constrain the movement of the material holder to a path between the first position and the second position.

11. The work surface assembly according to claim 1, further comprising two storage devices.

12. The work surface assembly according to claim 1, wherein the fixed portion is a wall of the work surface assembly and the movable portion comprises a majority of a usable work surface.

13. The work surface assembly according to claim 1, wherein the second position exposes the material holder to the an external environment through an opening formed between the movable portion and the fixed portion.

14. A work surface assembly comprising:

a fixed portion;

a movable portion adapted to move with respect to the fixed portion; and a storage device including a material holder in connection with the movable portion and the fixed portion, the material holder moving from a first position to a second position in conjunction with movement of the movable portion;

wherein in the first position the material holder is located in a substantially covered configuration and in the second position at least a portion of the material holder is in an uncovered configuration;

wherein the material holder further comprises a first material bolder portion and a second material holder portion and wherein the first material holder portion and second material holder portions are positioned adjacent to one another;

wherein the first material holder portion comprises a flexible member having a first end attached to the movable portion and a second end attached to the fixed portion, wherein the movement of the movable portion stretches the flexible member from a substantially un-flexed configuration in the first position to a substantially flexed configuration in the second position.

15. The work surface assembly according to claim 14, wherein the second material holder portion further comprises a storage device having a track extending in a direction of movement of the movable portion, wherein the track is connected to the material holder and is adapted to receive a guide connected to the movable portion.

16. The work surface assembly according to claim 15, wherein:

the track includes a slot;

at least a portion of the guide rests within the slot; and movement of the movable portion moves the guide along the slot to move the material holder from the first position to the second position.

17. The work surface assembly according to claim 16, wherein the guide connects to the movable portion with a bracket.

18. A desk assembly comprising:

a fixed portion;

a movable portion adapted to move with respect to the fixed portion;

a material holder; and a movement assembly comprising a track that extends in a direction of movement of the movable portion and is angled with respect to the moveable portion and a guide cooperating with the material holder and the movable portion;

wherein the track is attached to the material holder and has a slot that receives the guide such that movement of the movable portion moves the guide along the slot to move the material holder from a first position in an internal environment of the desk such that the material holder is located in a substantially covered configuration to a second position that exposes the material holder to an external environment of the desk such that the material holder is located in a substantially uncovered configuration in conjunction with movement of the movable portion.

19. The desk assembly according to claim 18, wherein the fixed portion is a wall of the desk assembly and the movable portion comprises a majority of the working surface of the desk assembly.

20. The desk assembly according to claim 18, wherein the second position substantially exposes the material holder to the external environment through an opening formed between the movable portion and the fixed portion.

21. A desk assembly comprising:

a fixed portion;

a movable portion adapted to move with respect to the fixed portion;

a file holder; and a movement assembly comprising a track and a guide cooperating with the file holder and the movable portion;

a vertical track having a first portion connected to the fixed portion and a second portion connected to the file holder to substantially constrain the movement of the file holder between the first position and the second position;

wherein the track is adapted to provide a path for the guide to move the file holder from a first position in an internal environment of the desk such that the file holder is located in a substantially covered configuration to a second position that exposes the file holder to an external environment of the desk such that the file holder is located in a substantially uncovered configuration in conjunction with movement of the movable portion.

22. A desk assembly comprising:

a fixed portion;

a movable portion adapted to move with respect to the fixed portion; and a movement assembly comprising a flexible member having a first end attached to the fixed portion and a second end attached to the movable portion;

wherein movement of the movable portion in a direction away from the fixed portion changes a configuration of the flexible member from a slack configuration to a un-slacked configuration; and wherein the flexible member is in the slacked configuration in a first position in an internal environment of the desk when the moveable portion is substantially adjacent to the fixed portion such that the flexible member is located in substantially covered configuration and in an un-slacked configuration in a second position when the moveable portion is spaced away from the fixed portion such that the flexible member is located in a substantially uncovered configuration so as to exposes the flexible member to an external environment of the desk assembly.

23. The desk assembly according to claim 22, wherein the flexible member includes a component.

24. The desk assembly according to claim 23, wherein the component is an electrical outlet or device.

25. A desk assembly comprising:

at least two supports, wherein each of the supports has a top surface;

a panel positioned between the two supports and defining a knee space; and a movable portion positioned between the supports and adapted to move between a first position substantially aligned with the top surface of the supports and a second position misaligned with the top surface of the supports, in at least one direction;

a flexible member having a first portion attached to the moveable portion and a second portion attached to one of the supports such that the flexible member cooperates with the movable portion to move between a first position in an internal environment of the assembly to a second position exposed to an external environment of the assembly such that movement of the moveable portion stretches the flexible member from a substantially un-flexed configuration in the first position to a substantially flexed configuration in the second position; and wherein the top surfaces of the supports and the movable portion each form a portion of a top surface of the desk assembly.

26. The desk assembly according to claim 25, further including a component positioned in the flexible member.

27. The desk assembly according to claim 25, wherein the at least two supports include a first pedestal and a second pedestal.

28. The desk assembly according to claim 25, further comprising a storage device having a track extending in a direction of movement of the movable portion, wherein the track is connected to the storage device and is adapted to receive a guide connected to the movable portion.

29. The desk assembly according to claim 28, wherein:

the track includes a slot;

at least a portion of the guide rests within the slot; and movement of the movable portion moves the guide along the slot to move the material bolder from the first position to the second position.

30. The desk assembly according to claim 29, wherein the guide connects to the movable portion with a bracket.

31. The desk assembly according to claim 28, further comprising a vertical track cooperating with the fixed portion and the material holder to allow the material holder to move only between the first position and the second position.

* * * * *